US006375318B1

(12) United States Patent
Johnson

(10) Patent No.: US 6,375,318 B1
(45) Date of Patent: Apr. 23, 2002

(54) HEATED MEDIA INPUT TRAY FOR AN IMAGING DEVICE

(75) Inventor: Steven M. Johnson, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/399,863

(22) Filed: Sep. 21, 1999

(51) Int. Cl.[7] ..... B41J 2/01
(52) U.S. Cl. ..... 347/102; 347/104; 399/97
(58) Field of Search ..... 347/102, 104; 271/42; 399/97

(56) References Cited

U.S. PATENT DOCUMENTS 5,040,777 A * 8/1991 Bell et al. ..... 271/42
5,052,674 A * 10/1991 Bell ..... 271/42
5,406,321 A 4/1995 Schwiebert et al. ..... 347/102
5,500,667 A * 3/1996 Schwiebert et al. ..... 347/102
5,633,668 A 5/1997 Schwiebert et al. ..... 347/102

FOREIGN PATENT DOCUMENTS

JP 06206306 A * 7/1994 ..... B41F/21/00

* cited by examiner

*Primary Examiner*—John Barlow
*Assistant Examiner*—Manish S. Shah
(74) *Attorney, Agent, or Firm*—Lane R. Simmons

(57) ABSTRACT

A media input tray for an imaging device such as a laser printer is configured to heat media disposed in the tray in order to reduce potential curl of the media caused by image processing in the imaging device. In a preferred embodiment, the input tray is configured with a flexible printed circuit having conductive traces for dissipating heat in response to an electric current. The flexible circuit is coupled to a power supply in the imaging device to enable a continuous warming of media in the tray, independent of any imaging operations by the imaging device. A method of image processing includes providing a heating device in a media input tray of an image processing device, and heating the media disposed in the input tray with the heating device such that media curl, caused by image processing operations, is reduced.

24 Claims, 3 Drawing Sheets

HEATED MEDIA INPUT TRAY FOR AN IMAGING DEVICE

FIELD OF THE INVENTION

This invention relates in general to image forming devices and, more particularly, to pre-heating media in an input tray for reducing media curl caused by image processing.

BACKGROUND OF THE INVENTION

Conventional electrophotographic imaging devices, such as laser printers, facsimile machines or copiers, operate by using a roller or a series of rollers to pull a sheet of media (typically a sheet of paper) from an input tray and to move the media to a registration roller assembly. The registration roller assembly aligns the media so that the edges of the media are parallel to the media path. Once the media is properly aligned, the registration roller assembly passes the media to an optical photoconductor (OPC) surface, such as a drum or belt. The OPC has a latent image on its surface formed by scanning a laser across the surface. A difference in electrostatic charge density is created between the areas on the surface exposed and unexposed to the laser beam. A visible image is developed by toners that are selectively attracted to the OPC surface, either exposed or unexposed to light, depending on the relative electrostatic charges of the OPC surface, development electrode, and the toner. The OPC may be either positively or negatively charged, and the toner similarly may contain negatively or positively charged particles.

The media is given an electrostatic charge and passed close to the photoconductor surface. As the media passes close to the photoconductor surface, it pulls the toner from the photoconductor surface onto the media still in the pattern of the image developed from the photoconductor surface. After receiving the image, the media is passed to a fuser. The fuser heats the toner image on the media, bonding the toner to the media.

The temperature of the fuser is critical. Rough or thick media requires a higher fuser temperature than smooth or thin media. In either case, if the fuser temperature is too low, toner will not be adequately fused to the media. On the other hand, if the temperature is too high, the toner will be pulled from the media by the fuser and the media may be damaged. Either case results in an undesirable print defect.

Notably, over fusing can cause the media to curl, wrinkle, or warp and possibly jam the printer. However, other factors also affect media curl, wrinkle or warping, including composition and weight of the media, moisture content of the media, whether one or both sides of the media is imaged, toner distribution on the media, fusing temperature, fusing configuration (i.e., single or dual heated fuser rollers), ejection speed of the media when leaving the printer, and external environmental factors such as temperature and humidity. For example, media curl is common in environments where air conditioning is unavailable to moderate humid conditions. In such situations, media moisture content is naturally high. As a result, media curl, wrinkle or warping may occur simply due to the moisture being quickly driven off during normal image fusing, even if the printer parameters are optimally established.

Many of these factors affect media curl not only in electrophotographic imaging systems but also in ink jet imaging systems. For example, notably, the heavy moisture concentrations in conventional liquid inks causes the inks to soak into conventional paper media and, in combination with ink distribution on the media, causes the media to curl, wrinkle or warp.

Accordingly, an object of the present invention is to reduce media curl often caused by conventional image processing techniques and environmental conditions.

SUMMARY OF THE INVENTION

According to principles of the present invention, a media input tray for an imaging device such as a laser printer is configured to heat media in the tray in order to reduce potential curl of the media caused by image processing in the imaging device. In a preferred embodiment, the input tray is configured with a flexible printed circuit having conductive traces for dissipating heat in response to an electric current. The flexible circuit is coupled to a power supply in the imaging device to enable a continuous warming of media in the tray, independent of imaging operations by the imaging device.

According to further principles, a method of image processing includes providing a heating device in a media input tray of an image processing device and heating the media disposed in the input tray with the heating device such that potential media curl, caused by image processing operations, is reduced.

Other objects, advantages, and capabilities of the present invention will become more apparent as the description proceeds.

DETAILED DESCRIPTION OF THE INVENTION

Figure 1:
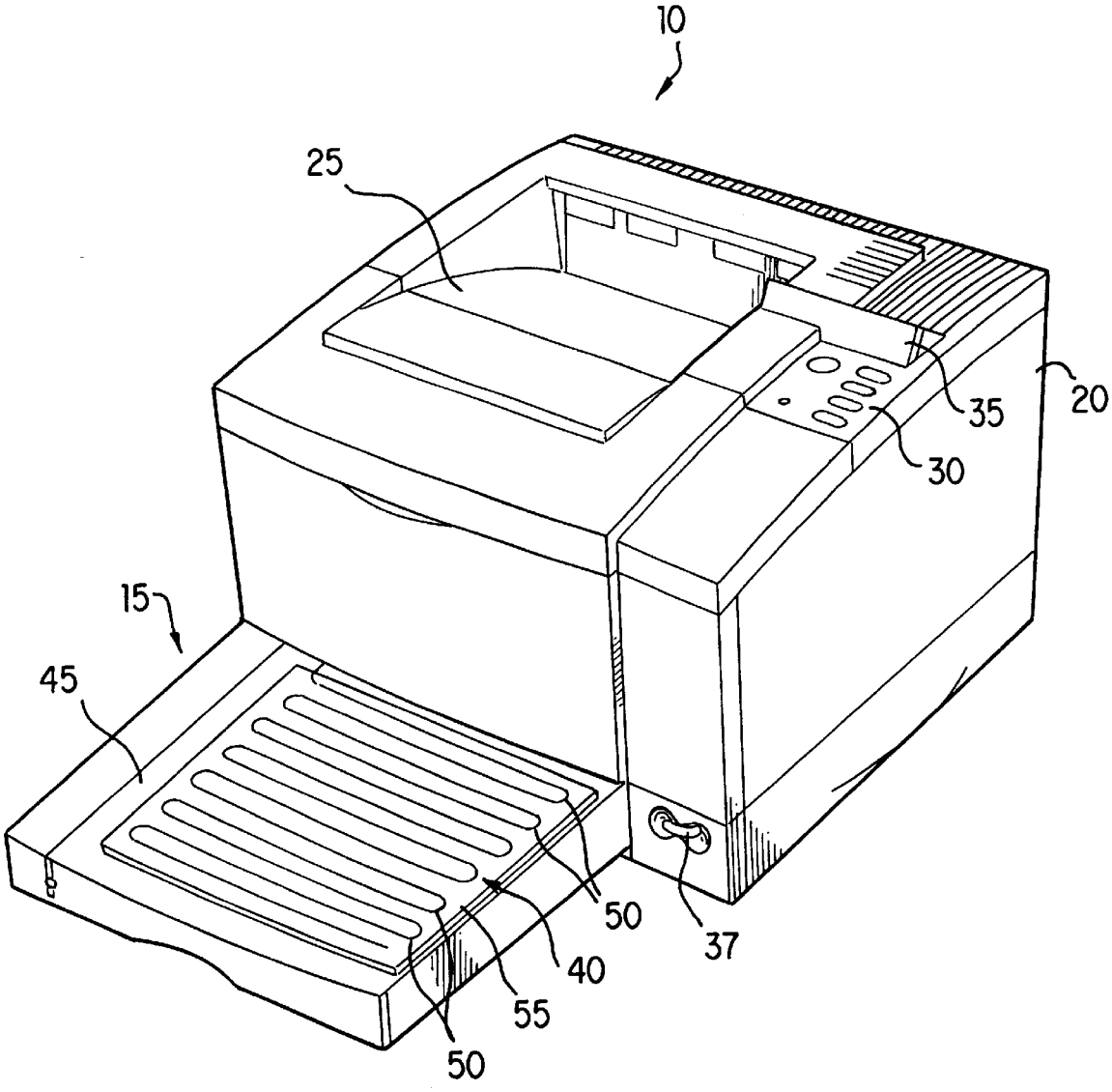
FIG. 1 is a perspective view of a page printer embodying the present invention heated media input tray.

FIG. 1 is a perspective view of a page printer 10 embodying the present invention heated media input tray 15. Although printer 10 is described as an electrophotographic imaging device employing conventional laser imaging technology, it is understood that the present invention heated media input tray 15 is similarly feasible in other media processing apparatus, such as ink jet printers, facsimile machines, and photocopiers.

Printer 10 includes an electrophotographic imaging system (not shown) disposed within housing 20. Printer 10 further includes media input tray 15 for holding media to be image processed by printer 10, media output bin 25 for holding imaged media that have been image processed by printer 10, control panel 30, information display 35, and power switch 37.

The present invention media input tray 15 is shown in an extended or open position relative to housing 20 so as to receive media therein by a user and so as to more clearly view resistive heating device 40 disposed therein. In a preferred embodiment, heating device 40 is a planar flexible printed wiring substrate, often referred to as a flex assembly or flex circuit, and is disposed adjacent a bottom support member 45 of tray 15. Alternatively, heating device 40 includes a rigid printed wiring substrate or other resistive heating mechanism. In further alternate embodiments, heating device 40 includes resistive elements formed into (as part of) tray 15 or includes any other mechanism that generates or radiates heat.

Flex circuit 40 includes one or more laterally spaced conductive traces 50 (such as aluminum or copper) formed on a flexible non-conductive layer 55 (such as Mylar or polyamide) as is known in the printed circuit art. The conductive traces 50 are electrically coupled to a power supply disposed within housing 20. Flex circuit 40 is disposed within tray 15 such that sheet media (not shown) rests upon the flex circuit when the media is inserted into the tray for use by printer 10. In this context, the media when held in tray 15 is warmed and maintained at an elevated temperature by flex circuit 40 before being image processed by printer 10. Importantly, the elevated temperature reduces curling, wrinkling or warping of the media during image processing by printer 10.

Figure 2:
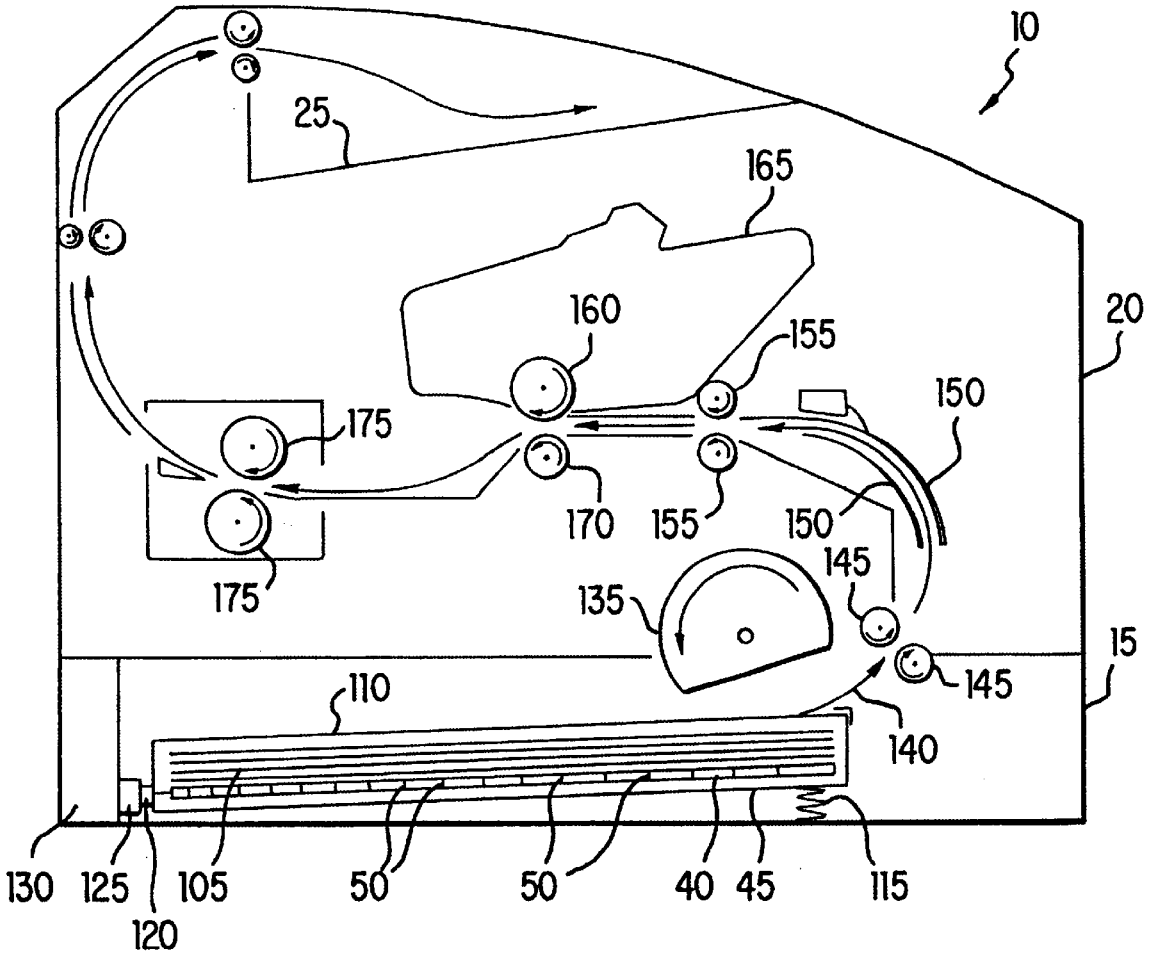
FIG. 2 is a schematic block diagram of the printer of FIG. 1.

Referring now to FIG. 2, a schematic block diagram of printer 10 is depicted. Here, media input tray 15 is shown having sheet media 105 disposed in sheet stack support member 110 which is biased upward by spring bias 115. Media 105 rests on top of flex circuit 40 such that conductive warming of the media occurs and a maintaining of the media at an elevated temperature occurs in response to electric current supplied through the resistive electrical traces 50. Flex circuit 40 is disposed adjacent bottom support member 45 of sheet stack support member 110 in tray 15.

Conductive traces 50 terminate in contacts at an outer edge of flex circuit 40. The contacts interface with an electrical connector 120 as conventional in the art. Connector 120 couples with receptor 125 which is coupled to power supply 130. In this configuration, as tray 15 is extended out from within housing 20 (see FIG. 1), connector 120 is disconnected from receptor 125 such that power is no longer provided to flex circuit 40. However, when tray 15 is pushed back into its home position (shown) within housing 20, connector 120 is guided to properly mate with receptor 125 such that flex circuit 40 is power enabled for heating media 105.

Although not shown, other configurations for transferring power to flex circuit 40 are similarly feasible and contemplated. For example, in an alternate embodiment, a flexible, elongated power cable couples power supply 130 to connector 120. In this context, as tray 15 is extended out from within housing 20, the power cable is snaked out along with the tray such that connector 120 remains connected to the power cable so that connection is continuously maintained with flex circuit 40. Additionally, when tray 15 is pushed back into its home position within housing 20, the power cable is retracted to not interfere with tray 15, yet connector 120 remains connected for continuously heating media 105.

Whatever the power connection chosen, in a preferred embodiment flex circuit 40 is continuously powered by power supply 130 regardless of the "on" or "off" status of printer 10 as controlled by power switch 37 (so long as the printer itself is plugged into an external power source as conventional in the art). In this manner, media 105 continuously remains at an elevated temperature, even if the printer is unused for imaging operations for extended periods of time, such as over night. In this context, a low power consumption of ten (10) to twenty (20) watts by flex circuit 40 is preferred.

If a continuously heated state is not desired, other power enabling configurations are similarly feasible and contemplated. For example, in an alternate embodiment, the supply of power to flex circuit 40 is controlled in relation to the "on" or "off" status of power switch 37. In yet another alternate embodiment, the supply of power to flex circuit 40 is governed by firmware resident in memory of printer 10. For example, upon detecting a power-on cycle for printer 10, the firmware enables a higher wattage (i.e., about 20 watts) to be supplied to flex circuit 40 for a predetermined amount of time for initial warming of media 105, after which the wattage is reduced (i.e., to about 10 watts) for the remaining time. Alternatively, numerous other variations of control as enabled by the firmware or other software or hardware are equally feasible. For example, in yet a further embodiment, power to flex circuit 40 is thermostatically governed.

Now, the longer the amount of time that media 105 remains in tray 15, the warmer and more dried it becomes as moisture is driven off, up to the point of elevated temperature saturation. However, obviously, sheets at the top of the stack of media 105 will be slower to warm than sheets at the bottom of the stack. In this context, in an alternate embodiment (not shown), dual flex circuits are utilized to heat not only from the bottom up but also from the top down. Alternatively, flex circuit 40 is disposed so as to be biased only against the top of the stack of media 105. This embodiment is helpful where the top sheet is picked for processing because it will be the most quickly heated. In any case, this warming and drying of media 105 in tray 15 is especially helpful in environments where external temperatures and humidity factors are high. Again, the less moisture that is absorbed in the media, then the less curl, wrinkling and warping will occur during image processing by the printer.

The general operation of printer 10 is described as follows. Media 105 as placed in tray 15 by a user is warmed to an elevated temperature by conductive heat transfer in response to flex circuit 40 being enabled by power supply 130. Upon initiation of an image transfer operation by printer 10, feed roller 135 picks top sheet 140 from media stack 105 in input tray 15 and advances it to a pair of transport rollers 145. Transport rollers 145 further advance sheet 140 through paper guides 150 toward registration rollers 155. Registration rollers 155 advance sheet 140 to photoconductive drum 160 (of toner cartridge 165) and transfer roller 170 where toner is applied as conventional in the art. Sheet 140 then moves through heated fuser rollers 175 where the toner is fused or bonded to the media. Finally, the sheet is passed upward and ejected into output bin 25.

It should be noted here that, in a preferred embodiment, flex circuit 40 is configured to be removably coupled to a bottom portion of tray 15, such as adjacent bottom support member 45 of sheet stack support member 110 in tray 15. As such, flex circuit 40 is adaptively fitted into tray 15 as an optional component or accessory. Alternatively, flex circuit 40 is formed into, or as a part of, the bottom portion of sheet stack support member 110. As such, tray 15, having flex circuit 40 formed therein, is adaptively fitted into printer 10 as a complete optional component or accessory.

Figure 3:
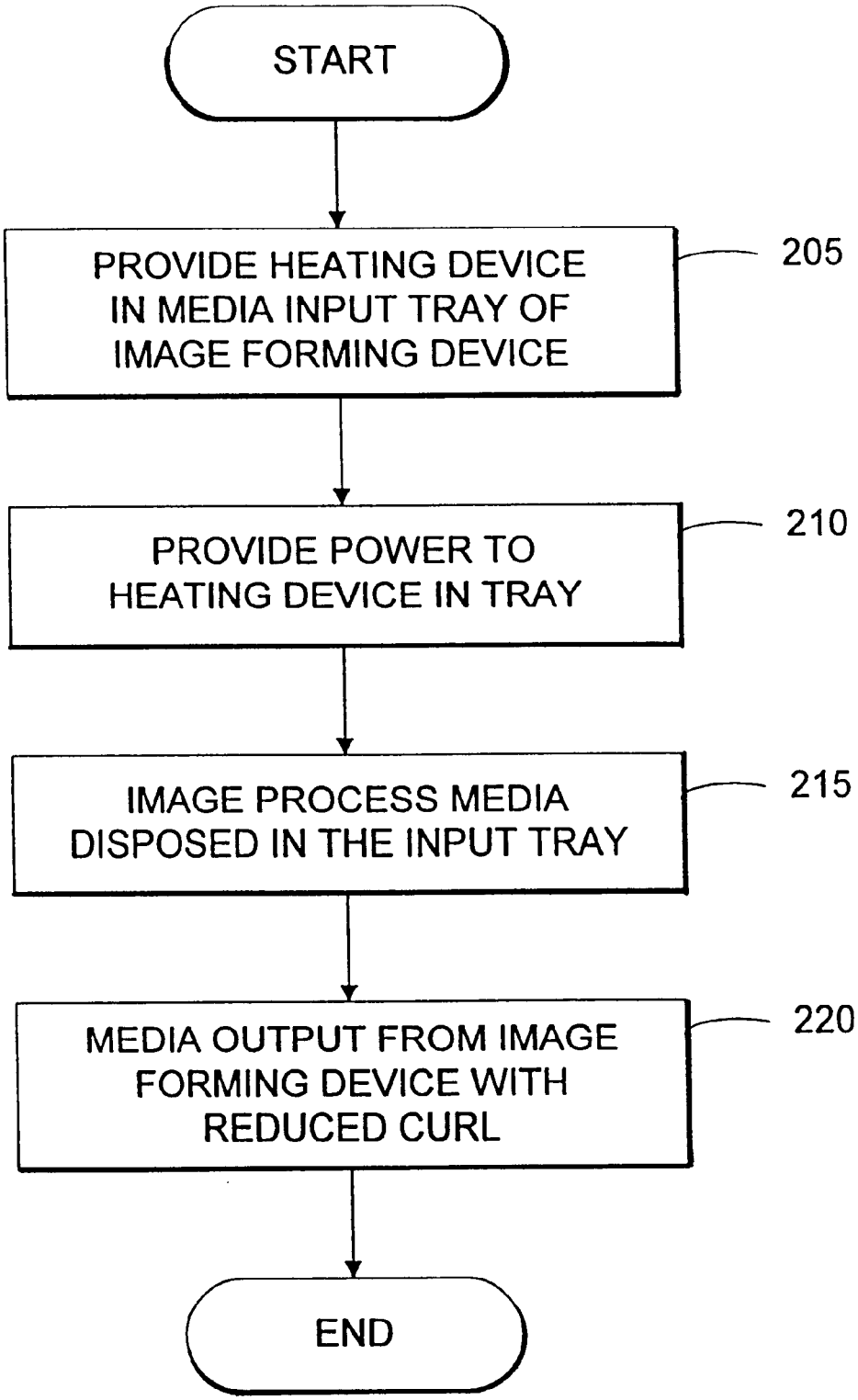
FIG. 3 is a flow chart depicting a preferred method of the present invention.

Referring now to FIG. 3, a flow chart depicts a preferred method of the present invention. First, 205, flex circuit 40 is provided in tray 15. Next, 210, power is supplied to flex circuit 40 such that conductive traces 50 dissipate heat to media 105 disposed in the tray. Subsequently, 215, the media is image processed through printer 10. Consequently, 220, the media is output to bin 25 with reduced curl, wrinkle or warping, due to the media having been pre-heated in tray 15.

Finally, it will be obvious to one of ordinary skill in the art that the present invention is easily implemented utilizing any of a variety of components existing in the art. Moreover, while the present invention has been described by reference to specific embodiments, it will be apparent that other alternative embodiments and methods of implementation or modification may be employed without departing from the true spirit and scope of the invention.

What is claimed is:

1. An imaging device, comprising:

(a) a print engine;

(b) a media input tray coupled to the print engine for providing media to the print engine; and, (c) a heat generating mechanism, including a printed wiring substrate, coupled to the media input tray and configured so as to heat media disposed in the input tray.

2. The imaging device of claim 1 wherein the print engine is an electrophotographic device.

3. The imaging device of claim 1 wherein the print engine is an ink jet device.

4. The imaging device of claim 1 wherein the heat generating mechanism includes a resistive heating device.

5. The imaging device of claim 1 wherein the heat generating mechanism is disposed in association with a bottom support member of the media input tray.

6. The imaging device of claim 1 wherein the heat generating mechanism is formed as part of the media input tray.

7. The imaging device of claim 1 further including a power source coupled to the print engine, and wherein the power source is configured to provide power to operate the heat generating mechanism.

8. A media input tray for a media processing apparatus, comprising:

(a) a support structure configured to hold media and to couple with the media processing apparatus; and, (b) a resistive heating device, including a printed wiring substrate, disposed in association with the support structure, the resistive heating device configured to couple with the media processing apparatus for receiving an enabling energy therefrom.

9. The media input tray of claim 8 wherein the media processing apparatus includes an electrophotographic device.

10. The media input tray of claim 8 wherein the media processing apparatus includes an ink jet device.

11. The media input tray of claim 8 wherein the resistive heating device is disposed in association with a bottom support member of the support structure.

12. The media input tray of claim 8 wherein the resistive heating device is formed as part of the media input tray.

13. A method of image processing, comprising:

(a) providing a print engine;

(b) providing a media input tray coupled to the print engine;

(c) providing a heating device, including a printed wiring substrate, in connection with the media input tray; and, (d) enabling the heating device for heating media in the media input tray prior to the print engine processing the media.

14. The method of claim 13 wherein the print engine is an electrophotographic device.

15. The method of claim 13 wherein the print engine is an ink jet device.

16. The method of claim 13 wherein the heating device includes a resistive heating device.

17. The method of claim 13 further including providing energy to operate the heating device during imaging operations and during idle time of the print engine.

18. An imaging device, comprising:

(a) a housing;

(b) a print engine disposed in association with the housing; and, (c) a media input tray disposed in association with the housing and configured to hold a plurality of sheets of media for use by the print engine, the media input tray including resistive heating elements therein for heating the plurality of sheets held in the input tray.

19. The imaging device of claim 18 further including a control apparatus configured to energize the resistive heating elements to heat the media in the input tray after power is decoupled from the print engine.

20. The imaging device of claim 18 further including resistive heating elements configured to bias against a top of the sheets of media held in the input tray.

21. A media input tray for a media processing apparatus, comprising:

(a) a support structure configured to hold a plurality of sheets of media and to provide the media to the media processing apparatus; and, (b) resistive heating elements in association with the support structure for heating the plurality of sheets held in the support structure, the resistive heating elements configured to communicate with the media processing apparatus to receive an enabling energy therefrom.

22. The media input tray of claim 21 further including resistive heating elements configured to bias against a top of the sheets of media held in the input tray.

23. A media input tray for a media processing apparatus, comprising:

(a) a support structure configured to hold a plurality of sheets of media and to provide the media to the media processing apparatus; and, (b) resistive heating elements disposed in association with the support structure for heating the plurality of sheets held in the support structure, the resistive heating elements configured to:

(i) bias against a top of the sheets of media held in the support structure; and (ii) communicate with the media processing apparatus to receive an enabling energy therefrom.

24. An imaging device, comprising:

(a) a housing;

(b) a print engine disposed in association with the housing; and, (c) a media input tray disposed in association with the housing and configured to hold a plurality of sheets of media for use by the print engine, the media input tray including resistive heating elements configured to bias against a top of the sheets of media held in the input tray for heating the plurality of sheets held in the input tray.

* * * * *